US006837473B2

(12) United States Patent
Petkau

(10) Patent No.: US 6,837,473 B2
(45) Date of Patent: Jan. 4, 2005

(54) METHOD AND APPARATUS FOR ERECTING FORMS FOR CONCRETE POURS

(76) Inventor: Bert Petkau, 3676 Blue Jay Street, Abbotsford, B.C. (CA), V2T 5G6

( * ) Notice: Subject to any disclaimer, the term of this patent is extended or adjusted under 35 U.S.C. 154(b) by 0 days.

(21) Appl. No.: 10/273,771

(22) Filed: Oct. 17, 2002

(65) Prior Publication Data

US 2003/0071189 A1 Apr. 17, 2003

Related U.S. Application Data

(60) Provisional application No. 60/334,759, filed on Oct. 17, 2001.

(51) Int. Cl.[7] ..... E04G 17/06
(52) U.S. Cl. ..... 249/216; 249/43; 249/190
(58) Field of Search ..... 249/43, 190, 191, 249/213, 216, 218

(56) References Cited

U.S. PATENT DOCUMENTS

| | | | | |
|---|---|---|---|---|
| 1,436,345 A | | 11/1922 | Jackson | |
| 2,502,672 A | | 4/1950 | Royther | |
| 2,709,292 A | | 5/1955 | Otti | |
| 3,648,961 A | | 3/1972 | Farrow | |
| 4,044,986 A | * | 8/1977 | Strickland et al. | 249/216 |
| 4,109,893 A | | 8/1978 | Laroche | |
| 4,159,097 A | * | 6/1979 | Strickland | 249/43 |
| 4,726,560 A | | 2/1988 | Dotson | |
| 5,282,603 A | | 2/1994 | Taraldsson | |

FOREIGN PATENT DOCUMENTS

| | | | | |
|---|---|---|---|---|
| AU | 147787 | * | 8/1950 | 249/43 |

* cited by examiner

*Primary Examiner*—Michael Safavi
(74) *Attorney, Agent, or Firm*—Robert B. Hughes; Hughes Law Firm, PLLC

(57) ABSTRACT

A tie-rod assembly which is adapted to be interconnected between two opposite wall forming sections that define a concrete receiving region where a concrete wall is formed. The tie-rod assembly comprises an elongate threaded tie-rod on which is positioned a sleeve section. The sleeve section has an elongate tapered sleeve with a frusto conical tapering outer surface, with a smaller diameter and fitting closely to the tie-rod and a larger diameter end. A threaded locating member is connected to the large diameter end, and by rotating the positioning member, the position of the sleeve section can be adjusted along the length of the tie-rod.

20 Claims, 4 Drawing Sheets

98
100
104
102
106
108
110

COMPLEX FORMING DETAILS
VARIOUS WALL WIDTHS
BLIND WALL FORMING
122
120
118
118

56a
124a
126a
52a 156a
70b
56b 130b
70b
56b
132b 134b
52b
136b 56b
70b
71b
50b

METHOD AND APPARATUS FOR ERECTING FORMS FOR CONCRETE POURS

RELATED APPLICATIONS

This application claims priority benefit of U.S. Ser. No. 60/334,759, filed Oct. 17, 2001.

BACKGROUND OF THE INVENTION a) Field of the Invention

This invention relates generally to the field of concrete form construction, and more particularly to the tie-rod assemblies which position the two form wall sections at the proper spacing distance from on another.

b) Background Art

A common method of constructing concrete walls is to form two wall form sections which have inner forming surfaces facing each other and spaced from each other by a distance equal to the thickness of the wall to be formed. Commonly, each of these walls is made of panels (e.g. 4'×8' plywood panels), with each set of panels being placed in a common plane. To maintain the panels properly spaced with respect to one another, there is commonly provided a bracing/positioning structure in the form of sets of horizontally extending walers and vertically aligned strongbacks which bear against the outside surface of the panels. Through openings are drilled through the walers and through the panels, and tie-rods extend through matching pairs of aligned openings formed in the two wall form sections. Then retaining members are connected to each outer end of the tie-rod, such as a wing nut or other nut which is threaded onto the end of the tie-rod to press against a metal bearing plate that in turn bears against the outside surface of one of the walers.

With the two wall form sections being properly positioned and spaced from one another, and with the tie assemblies (i.e. the tie-rods and the retaining devices) properly in place, then the pour of the concrete can proceed. Quite commonly, there are metal reinforcing rods and/or other reinforcing members positioned in the receiving area of the concrete to form the concrete wall or other concrete structure in the form of reinforced concrete. After the concrete has cured sufficiently, either or both of the retaining members are removed from each tie-rod, the tie-rods removed, and the two wall form sections are taken down and are generally at least partially disassembled in some manner.

Obviously, if the tie-rod is to be removed from the hardened concrete, provisions must be made to avoid the central portion of the tie-rod that is in the region of the concrete pour from becoming embedded in the concrete. Accordingly, there have been various attempts in the prior art to address this problem.

Further, in addition to the problem of removing the tie-rods, there have also been various arrangements to properly space the surfaces of the two form wall sections from one another. In other instances, such spacing devices are not used, and the force of the concrete in the receiving area bearing against the inside forming surfaces of the form wall sections (being held in place by the tie-rods) is depended upon to ensure the uniform thickness of the wall.

Two of the patents which are of interest are U.S. Pat. No. 4,044,986 (Strickland et al.) and U.S. Pat. No. 4,159,097 (Strickland). Both of these patents will be discussed later in this text after the brief description of the drawings, and in this section on background art, they will be discussed only briefly.

The earlier of these two patents (i.e. U.S. Pat. No. 4,044,986) relates primarily to various devices to anchor the tie-rods (in U.S. Pat. No. 4,044,986 called the "tie"). In FIGS. 20, 21, and 22, there are shown three tie-rod configurations of interest. These are discussed in the text of the patent beginning in column 9, line 42, and continuing on through most of column 10. It is stated that ". . . other forms of tie are equally suitable to practicing this invention. More particularly, solid ties preferably having a continuous taper, such as those illustrated in FIGS. 20, 21, and 22, may also be used to practice this invention. After the concrete structure has set, the continuous taper of these ties permits them to be driven out of engagement with the structure."

Each of the tie-rods shown in these three figures (FIGS. 20, 21, and 22) appear to be made from a single piece of metal (or at least made as on integral metal piece), and they differ mainly in the configuration of the end retaining sections that connect to a retainer so that the tension can be applied to the tie-rod.

The second patent of interest (U.S. Pat. No. 4,159,097) names Strickland (the first-named co-inventor of the early above-noted patent U.S. Pat. No. 4,044,986) as the sole inventor. In the introductory text of that patent (column 1, beginning on line 13), reference is made to U.S. Pat. No. 4,044,986, and it is stated that one of the features in the apparatus is the use of a tapered tie-rod. It is further stated that such tie-rods are conventionally made from a plurality of steel rods threaded together or cast into a one-piece steel tie that has sufficient strength to hold the form panels together and withstand the stresses imposed upon the ties. The patent goes on to recite the certain deficiencies in that design, and these will be discussed later in the text of this application.

The tie-rod in U.S. Pat. No. 4,159,097 differs from that of the earlier patent (U.S. Pat. No. 4,044,986) in that the tapered portion of the tie-rod is not made of steel and formed as part of the metal piece, but rather is made from a plastic sleeve that is firmly attached to the steel tie-rod. The reasons for this will be discussed later in this text.

A search of the U.S. patent literature has disclosed a number of other patents generally relevant to this technology of providing concrete forms, and each of these are discussed briefly below.

U.S. Pat. No. 5,282,603 (Taraldsson) relates to a clamping device to be used in concrete forms. In FIG. 1, there is shown a sealing element 7 which comprises two compressible end seals 27 & 28, and a frusto-conical center member 29 having a moderate taper and which is made of a relatively non-compressible material. When the tie-rod is tensioned, the sealing elements 27 & 28 close the two openings 8 & 9 in the forming boards 2.

U.S. Pat. No. 4,726,560 (Dotson) shows a concrete form tie assembly where there is a flexible plastic sleeve 20 which is placed over the tie-rod. There is a cone-shaped member 54 to act as a means of fixedly locating one end of the assembly 10.

U.S. Pat. No. 4,109,893 (Laroche) shows a conical mold panel spacer.

U.S. Pat. No. 3,648,961 (Farrow) discloses a wall tie for concrete forms. There is a tie-rod which extends through a spacer or spreader 32 which has a frusto-conical shape with a moderate taper. The operating position is at a location between the two boards of the concrete forming assembly and keeps the two boards spaced at the proper distance from one another. At one end of the spacer 32, the tie-rod has a threaded end member 44 on which a nut is threaded, and there are two washers 46 & 48 positioned on opposite sides of this threaded member 44. In the assembled position, as we had seen in FIG. 3, this nut 50 with the two washers 46 & 48 properly locates the spacer 32.

U.S. Pat. No. 2,709,292 (Otti) relates primarily to a clamp for concrete forms. There is shown a frusto-conical spacing member 20 having a moderate slant with the larger end bearing against the board member 12 and the opposite end bearing against the other board.

U.S. Pat. No. 2,502,672 (Roythe) discloses a tie-rod having a spreader or spacing member 6 which has threaded sockets on opposite sides. The tie-rod comprises two threaded members which are threaded into the end holes 8 & 9. The purpose of this is that when the concrete is being set, these function as a spacer. However, the spacers do not need to be removed until the concrete has hardened, this being due to the fact that the nuts can be unthreaded from the ends of the tie-rod while the spacer remains in place. After that, then the spacer can be removed.

U.S. Pat. No. 1,436,345 (Jackson) shows a tie-bar and a spacer. The spacer 13 is a frusto-conical member with a moderate taper and it is positioned between two opposing forming walls. In FIG. 10, the spacer is shown being used to form a double-wall container or other member.

SUMMARY OF THE INVENTION

The present invention provides a tie-rod assembly and a method of using the same in providing tie-rod connections between two sections of a wall-forming structure, with the wall-sections being spaced from one another to define a concrete receiving region.

There is a plurality of tie-rod assemblies which extend between the two opposite wall-forming sections, and through the concrete receiving region.

Each of the tie-rod assemblies comprises an elongate cylindrically shaped tie-rod having exterior threads along at least a portion of an outer cylindrical surface of the tie-rod. There is a sleeve section which is arranged to be moveably mounted on the tie-rod section. This sleeve section comprises first a tapered sleeve member having a forward end and a rear end and defining a through passageway to receive the tie-rod. The tapered sleeve member has an outer tapered surface with a small diameter forward circumferential edge sized to fit closely to the exterior surface of the tie-rod, and having a larger diameter rear end spaced regularly outwardly from the tie-rod.

Also, the sleeve section comprises a positioning member connected to the larger diameter portion of the tapered sleeve member. This positioning member has an interiorally threaded opening to receive the tie-rod and to threadedly engage the exterior threads of the tie-rod.

The tie-rod and the sleeve section are arranged so that with the sleeve section positioned with the tie-rod extending therethrough, the sleeve section can be rotated, and with the threaded positioning member engaging the threads of the tie-rod, to move the sleeve section to a desired location along the tie-rod.

The tapered sleeve member is configured and has the connection to the tie-rod which is such that after the concrete wall is formed, the tie-rod assembly can be removed by impacting the front end of the tie-rod and causing the tie-rod assembly to be moved out of the concrete wall formed in the forming region.

In a preferred form, the tapered sleeve member has its through passageway configured so as to expand in a direction from the forward end of the rear end of the sleeve member. Desirably this is accomplished by providing the tapered sleeve member in the form of a closed metal sheet having the configuration of a truncated cone.

Also, in a preferred form, there is provided a lock nut which threadedly engages the tie-rod and is able to be rotated into engagement with the positioning member to retain a positioning member at a desired location on the tie-rod.

In the method of the present invention, the tie-rod connections are provided for a forming structure for concrete walls having first and second forming sections on opposite side of the forming region where the concrete wall is to be made.

The method comprises first providing the tie-rods as described above and further providing the sleeve section as provided above, mounting the sleeve section onto the tie-rod and adjusting the position of the sleeve section. This is done so that end portions of the tie-rod that extend beyond the forward and rear ends of the sleeve section are sufficiently long so that the end portions of the tie-rods are able to extend through the forming sections to connecting locations, and so that the sleeve section is positioned in the forming region.

Then retaining devices are applied to opposite ends of the tie-rods to position the forming structures at the proper location for forming the concrete wall, after which the concrete wall is poured and is permitted to cure.

After the curing, force is applied to the first ends of the tie-rod assemblies to drive the tie-rod loose from the concrete wall structure and removing the tie-rod assemblies from the wall structure.

As an alternative embodiment, the elongate tie-rod is provided, either with or without the exterior threads. The sleeve section is also provided having the tapered sleeve member and also the positioning member. The positioning member has the opening to receive the tie-rod member, and there is a fastening device to engage the exterior surface of the tie-rod.

As a further alternative embodiment, the positioning member could be formed with partial threads, which for example, would be diametrically opposed, each having an arcuate length of less than 90 degrees. Then there could be similar opposing partial threads formed on the tie-rod. In this way the positioning member could be rotated to a desired position where the threaded portions are not in engagement, and the sleeve section can be moved along the length of the tie-rod and then rotated 90 degrees into locking engagement relative to movement along the tie-rod.

Also as a further modification, the positioning member can be formed as part of the sleeve, by crimping or forming the large diameter end portion of the sleeve, possibly utilizing additional metal material, to form the threads in the interior surface of the positioning member against the tie-rod or some other forming device and also have these formed as what is equivalent to an integral structure of the positioning member and the sleeve. Alternatively, the thread on the tie-rod could have at least one set of threads with a circumferential gap and the positioning member having a partial thread or threads capable of passing through said gap.

Other features of the present invention will become apparent from the following detailed description.

DETAILED DESCRIPTION OF THE PREFERRED EMBODIMENTS a) Discussion of Prior Art Patents U.S. Pat. No. 4,044,986 and U.S. Pat. No. 4,159,097

Figure 1:
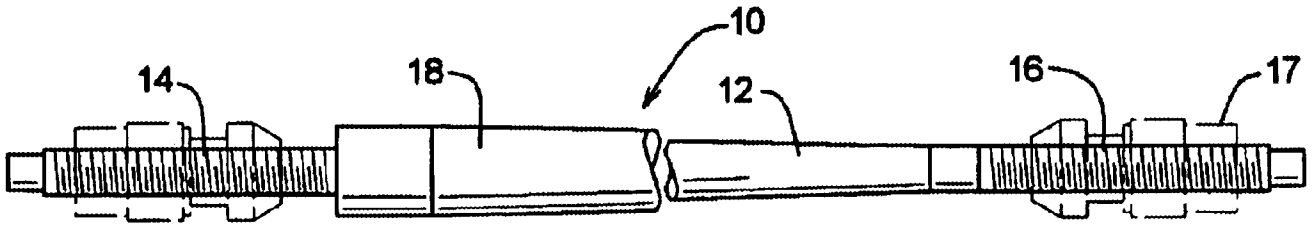
FIG. 1 PRIOR ART
FIGS. 1, 2, and 3 are three side elevational views of prior art tie-rods that are shown in U.S. Pat. No. 4,044,986.
Figure 2:
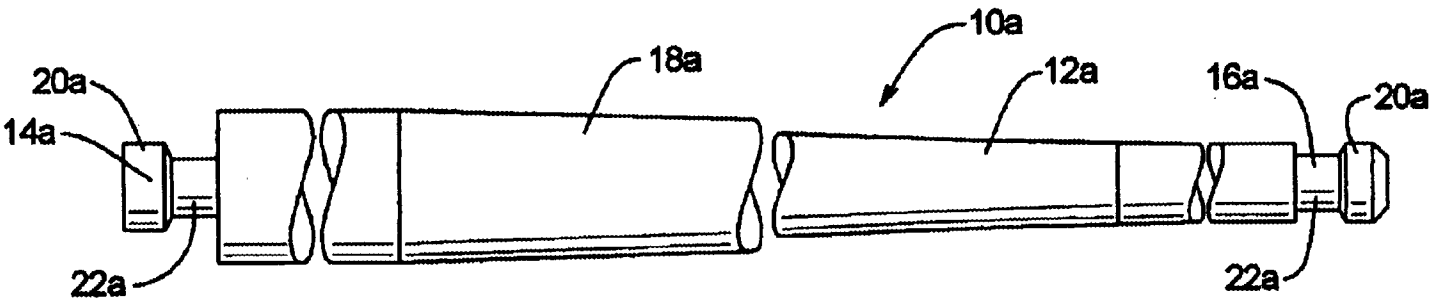
FIG. 2 PRIOR ART
Figure 3:
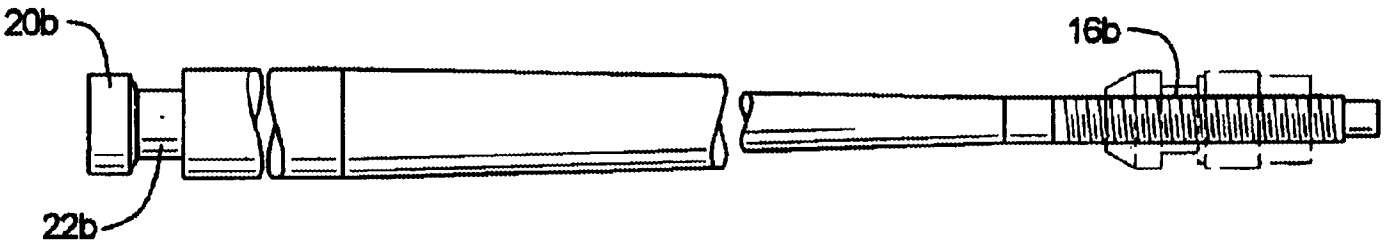
FIG. 3 PRIOR ART
Figure 4:
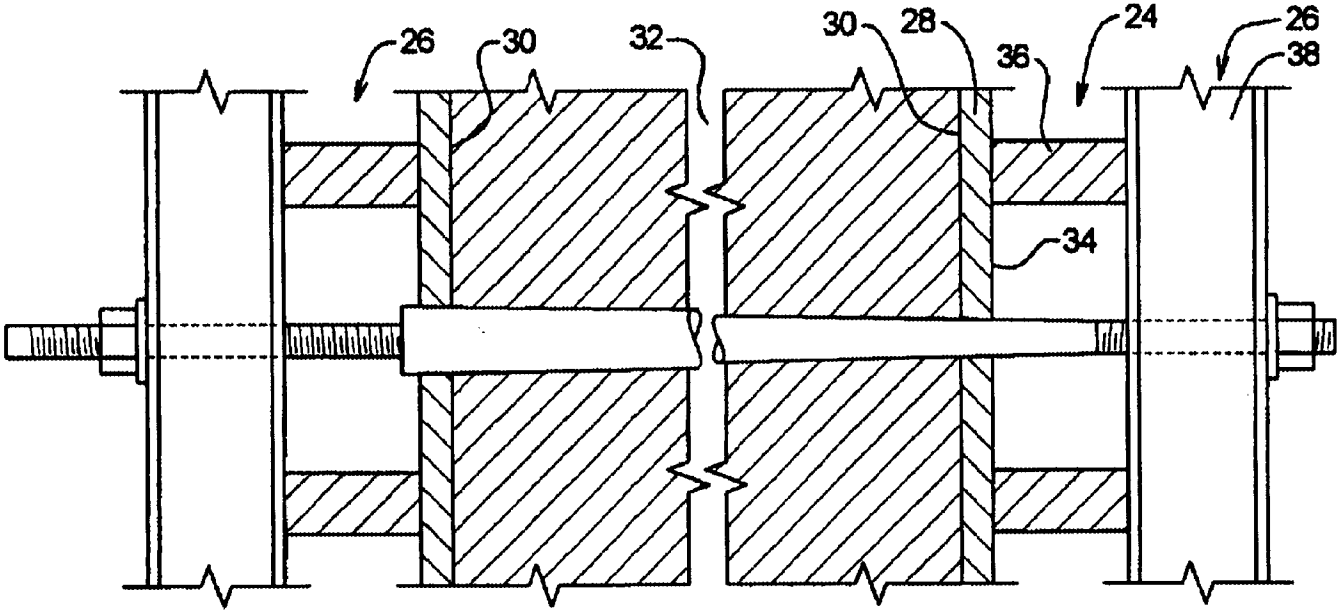
FIG. 4 PRIOR ART
FIG. 4 is a side elevational view, drawn partly in section, showing a prior art arrangement that is shown in U.S. Pat. No. 4,159,097, this arrangement of FIG. 4 showing the side forming sections being held together by a tie-rod which is described in U.S. Pat. No. 4,159,097.
Figure 5:
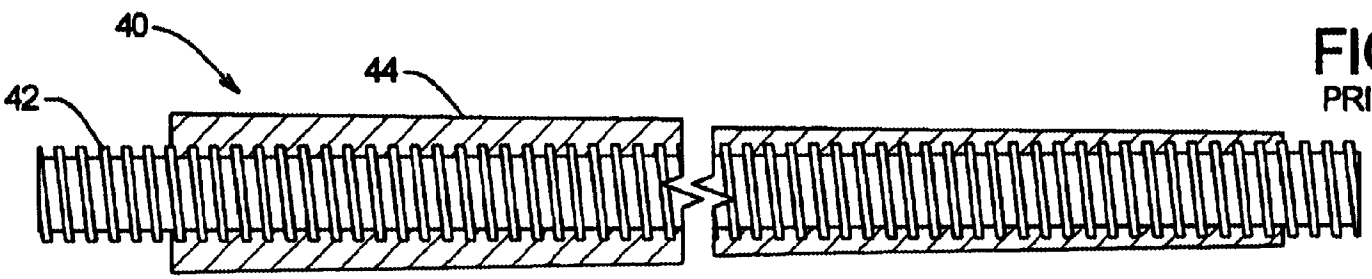
FIG. 5 PRIOR ART
FIG. 5 is a longitudinal view, partly in section, showing the tie-rod of FIG. 4 separately from the forming assembly.
Figure 6:
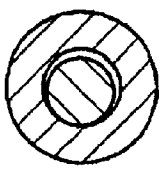
FIG. 6 PRIOR ART
FIG. 6 is a sectional view taken along line 6—6 of the prior art tie-rod of FIG. 3.

It is believed that clearer understanding of the construction, functions, and benefits of the present invention will be obtained by first reviewing the two prior art patents that were mentioned initially in the Background of the Invention as being of interest, namely U.S. Pat. No. 4,044, 986 and U.S. Pat. No. 4,159,097, with Mr. Strickland being a co-inventor in the first patent and the sole inventor in the second patent. There are shown in FIGS. 1–6 of this application, three figures from the earlier patent, and three figures from the later patent. FIGS. 1, 2, and 3 in this present application are the same figures that are shown in FIGS. 20, 21, and 22 of U.S. Pat. No. 4,044,986. FIGS. 4, 5, and 6 of the present application are the same as FIGS. 1, 2, and 3 of U.S. Pat. No. 4,159,097. In this text of this patent application, the components of FIGS. 1–6 will be given numerical designations beginning with the numeral 10 and increasing by increments from numeral 10, rather than using the numbers in the actual patents from which these derived. This is to avoid confusion of the numbering used in the text of this present application.

In FIG. 1, the tie-rod 10 comprises a middle tapered section 12 and two end connecting sections 14 and 16, both of which are threaded. There is at each end connecting section 14 and 16 a retaining nut 17, and these retaining nuts are described in the text of U.S. Pat. No. 4,044,986. The two threaded ends 14 and 16 have a uniform cross-section along their entire lengths, and the central tapered section 12 has a general frusto-conical outer surface 18 with a rather moderate taper from one end to the other.

FIG. 2 shows substantially the overall configuration of FIG. 1, and there is shown the tie-rod 10*a* having the central tapered section 12*a* having a tapered outer surface 18*a*. However, the connecting ends 14*a* and 16*a* are shaped somewhat differently in that each has an enlarged end portion 20*a*, with each end portion 20*a* being joined by a smaller necked-down portion 22*a*. A different type of retainer is used where a member is wedged into the space adjacent to the end 20*a* to perform the retaining function.

FIG. 3 shows substantially the same overall configuration as in FIGS. 1 and 2, except that at one end there is the threaded end 16*b* with the nut 17*b* and at the opposite end, the connection has the outer member 20*b* and the necked-down section 22*b*.

As indicated earlier in this text, in U.S. Pat. No. 4,044, 986, these three tie-rods are shown primarily for the purpose of indicating different tie-rod configurations that could be used in the invention disclosed in U.S. Pat. No. 4,044,986. Further, each of these appear to be made substantially as a unit without moving parts, and also being entirely metallic structures.

To discuss the prior art further, reference is now made to FIGS. 4, 5 and 6. In FIG. 4, there is shown a portion of the total concrete forming structure, and this is reasonably representative of the entire structure. This overall structure will first be described with reference to FIG. 4, and then the tie-rod used will be described with reference to FIGS. 5 and 6.

In FIG. 4, there is shown the concrete forming structure 24 comprising two form wall sections 26 spaced from each other. Each section 26 in turn comprises a panel section 28 comprising a plurality of panels (e.g. 4'×8' plywood panels), with only a portion of a single panel 28 being shown in each wall section in FIG. 4. Each panel section 24 has an inwardly facing forming surface 30, and the two facing surfaces 30 of the two panel sections 28 define therebetween the concrete receiving area 32.

Abutting against the outside surface 34 of each panel section 28 is a plurality of horizontal positioning/bracing members 36 (commonly called "strongbacks"), and outside of and pressing against the plurality of strongbacks 36 is a plurality of vertically aligned walers 38. These strongbacks 36 and walers 38 are commonly made from wooden posts (e.g. 4"×4", 6"×6", or 6"33 4" posts).

The tie-rod assembly 40 has substantially the same configuration as the tie-rod assembly 10 of the prior art as shown in FIG. 1. However, the materials from which it is made differ, in that the tie-rod is made as two parts of different material which are fixedly joined together. First, there is an elongate cylindrically shaped metal rod 42 that is threaded along its entire length. Then there is a tapered sleeve 44 made from plastic that is injection-molded onto the steel rod. The reasons for doing this are discussed in U.S. Pat. No. 4,159,097 in column 1, lines 26–42 as follows:

"A number of disadvantages are associated with ties fabricated from steel. When such ties are embedded inside the concrete column for the necessary length of time needed for the column to set, the ties sometimes rust or might have been rusty when first emplaced, thereby leaving rust spots on the completed concrete structure marring its appearance. Furthermore, steel ties are extremely heavy which increases their shipping weight and makes them difficult to handle. In addition, since such ties must often have a tapered shape, special casting equipment is needed to make the ties. If it were desired to vary the degree of the taper of otherwise change the shape of the steel tie, new and expensive casting equipment is required for each shape. Conventional steel ties are thus expensive to fabricate and, practically speaking, have a limited geometric capability."

In the Summary of the Invention, in column 1, lines 56–63, the rod in the invention of U.S. Pat. No. 4,159,097 is described as follows:

"These and other objects of the present invention are accomplished by providing a tie comprising an elongated, threaded steel rod having a central portion and opposed outer portions extending therefrom. The outer portions of the rod may be attached to conventional threaded anchoring means on a concrete form tying apparatus to hold the form panels together in a known manner."

In column 2, line 51 and following, the protective cover is described as extending substantially over the central section of the cylindrical rod, comprising two thirds of the entire length of the rod so that when the steel rod is installed through the concrete structure, the steel rod never comes into contact with the structure. Then in column 3, line 1 and following, it is indicated that the protective cover (i.e., the tapered plastic sleeve) also serves to encase and protect the steel rod itself, thereby inhibiting the formation of rust on the rod in the first place.

In claim 3 of U.S. Pat. No. 4,159,097, in the first part of the third paragraph, and also in claim 7 of the patent, in the first part of the third paragraph, the protective sleeve is claimed as follows:

"a protective plastic sleeve covering and integrally secured along its length to said rod to protect and be fixed against movement relative to said rod . . . "

It can be seen from observing FIG. 4 (which corresponds to FIG. 1 of U.S. Pat. No. 4,159,097) that the use of the tie-rod assembly 40 would be substantially the same as the use of the tie-rod assembly shown in FIG. 1 (corresponding to FIG. 20 of U.S. Pat. No. 4,044,986), except that there are differences in the manner in which the threaded connecting ends of the tie-rod assembly are connected to a retaining device.

b) First Embodiment of the Present Invention

Figures 7, 8, 8A, 9:
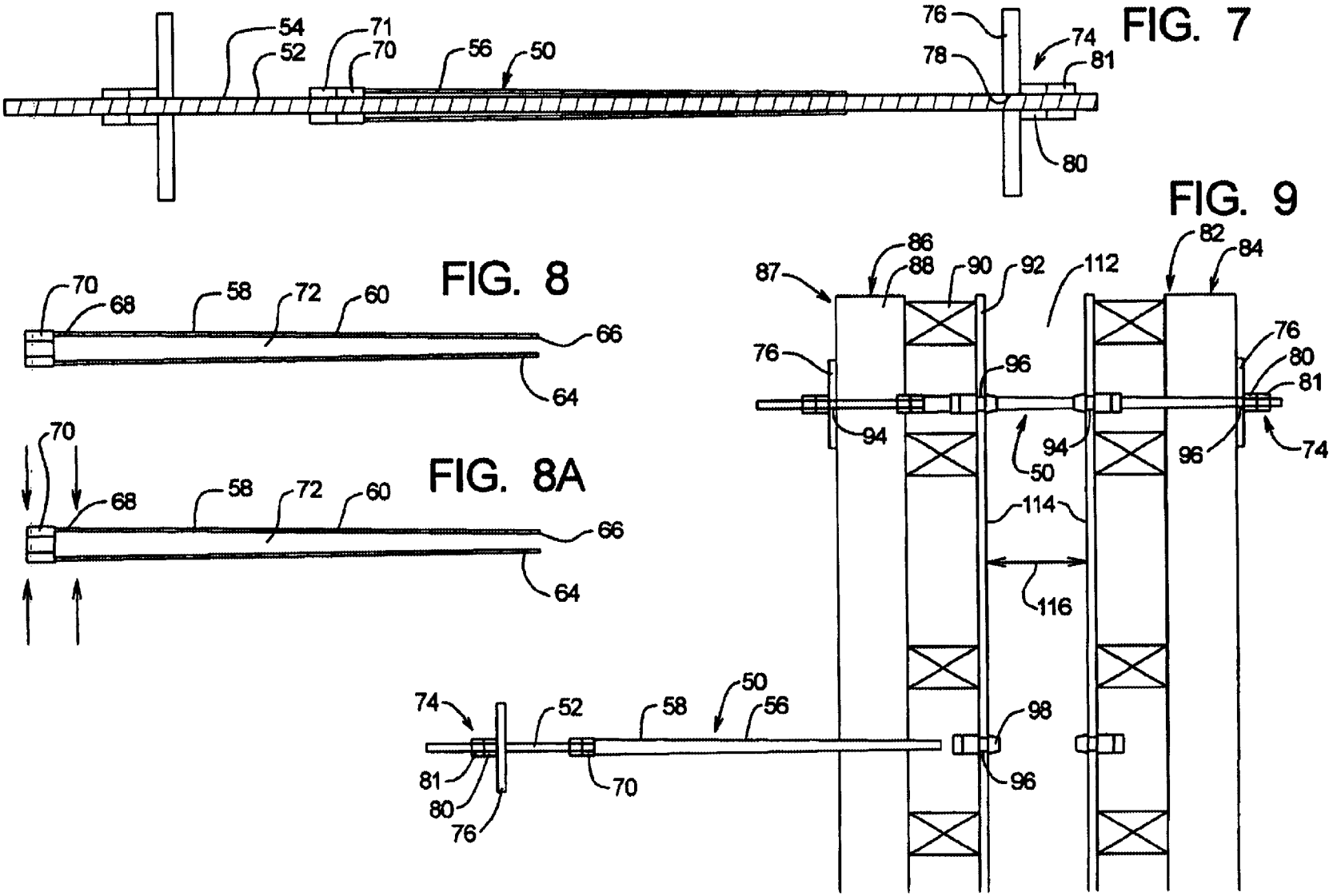
FIG. 7 is a side elevational view, partly in section, showing a tie-rod assembly of the present invention.
FIG. 8 is a side elevational view, partly in section, showing the sleeve of the tie-rod assembly of FIG. 8 of the present invention.
FIG. 8A shows a schematic method for crimping the wider tapered region to the positioning member where the positioning member could be attached by a metal to metal bonding material as well.
FIG. 9 is a side elevational view, partly in section, showing a forming structure in which the present invention can be utilized, and showing two tie-rod assemblies of the present invention, namely an upper tie-rod assembly which is in its operating position installed in the form assembly, and at the lower part a tie-rod assembly which is about to positioned in its operation position in the form assembly.

This first embodiment of the tie-rod assembly is shown in FIG. 7. The tie-rod assembly 50 of the present invention comprises an elongate cylindrical steel rod 52 having a uniform cylindrical cross-section and an exterior surface 54 which is threaded along its entire length. Such a threaded steel rod is conventional in the prior art, is readily commercially available, and is used in various commercial applications. Then there is a sleeve section 56 which is mounted to the rod 52 in a manner that the sleeve section 56 can be moved to various locations along the length of the rod 52 and held fixedly in such selected location or locations.

This sleeve section 56 comprises a tapered sleeve member 58 that, in this particular embodiment, is shown as comprising a metal wall 60 formed in a frusto-conical shape and having a tapered outer surface 62. In this particular embodiment, the metal wall 60 is conveniently made with a uniform thickness. The tapered sleeve member 58 has a smaller diameter end 64 having an end circular edge 66 and a larger diameter end portion 68.

The sleeve section further comprises an interiorly threaded positioning member 70, which in this particular configuration comprise a positioning nut member 70 which is fixedly connected to the larger diameter end portion 68 of the sleeve member 58. The threads of the nut 70 are configured to match the threads at the surface 54 of the rod 52. There is also provided a lock nut 71 by which the positioning nut may be locked at a specific location on the rod 5. The tapered sleeve member 58 defines an elongated central through opening 72, which in this particular embodiment, increases in diameter from the end portion 64 to the opposite end portion 68. The diameter of the smaller end portion 64 is sized so that it fits closely around the rod 52, but yet permits the sleeve section 56 to be moved along the length of the rod 52.

With reference to FIG. 7, there is shown a pair of end retainers 74 which, in and of themselves, are conventional. Each retainer 74 comprises a metal bearing plate 76 having a central through opening 77 to accommodate the rod 52. A retaining nut 80 and a lock nut 81 are threaded onto the end of the rod 52. Such retainers 74 are conventional, and of course other arrangements of retaining members could be used.

To describe the operation of the present invention, reference is made to FIG. 9 which shows a pair of tie-rod assemblies 50, one of which has already been positioned in the concrete forming structure, and the other of which is being moved into its operating position in the structure.

The concrete form structure 82, which is shown in FIG. 9, is (or may be) of conventional design and be substantially the same as the form structure shown in FIG. 4 as prior art. Thus, there are two wall form sections 84 and 86, each of which has a positioning structure 87 which in turn comprises outer walers 88 and the strongbacks 90 which position the two panel sections 92. Normally, in a typical operation of erecting the forms to pour a concrete wall, the two form sections 84 and 86 will first be assembled and positioned as shown in FIG. 9. There are openings 94 formed in the walers 88 and also matching openings 96 in the panel sections 92. The two wall form sections 84 and 86 are arranged with openings 96 so that there are matching sets of openings 94/96, in alignment with one another, with these matching openings being at the various tie locations in the concrete forming structure 82.

In this particular embodiment of FIG. 9, there are shown inserts 98 which are located in the openings 96, and these inserts can be designed to be one of those which are already commercially available. One such insert is shown in a perspective view of FIG. 10, and comprises two members which can be engaged with one another so as to provide a through opening 96 to accommodate the tie-rod assembly 50. In the particular arrangement shown in FIG. 10, the insert 98 comprises a first member 100 having an end portion 102 having an outer frusto-conical surface 104, with this end portion 102 being connected to a cylindrical threading portion 106. The threaded portion in turn is threaded into a circular retainer 108 having end connection interior threads and annular positioning flange 110. These two members 102 and 108 are positioned on opposite sides of the panel 92 and connected by their threaded connections to form a snug fit at the panel section 92 and provide a through opening of a proper diameter. The tapered surface portion 104 extends a short distance into the pouring area, and its tapered configuration permits the panel sections 92 to be removed from the concrete structure after the concrete has cured. This spacing member 98 is shown by way of example, and it could either be omitted entirely or another arrangement could be used.

To further describe the operation of the present invention, reference is made to the lower part of FIG. 9 where it can be seen that the tie-rod assembly 50 has been partially assembled so that the tie-rod 52 has at its left end the retainer 74 comprising the metal bearing plate 76, the retaining nut 80, and the lock nut 81. The sleeve section 56 has already been mounted to the rod 52, and the particular position of the sleeve section 56 has been selected by rotating the sleeve 56 (comprising both the body member 58 and its attached positioning nut 70) so that it is properly positioned relative to the particular arrangement of the forming structure 82.

The tie-rod assembly 50 is then moved through the pair of aligned openings 94/96 into the position shown in the upper part of FIG. 9, and then the second retainer 74 is secured to the opposite end (shown in the right part of FIG. 9) and the retaining nut 80 is rotated so that the two retaining plates 76 are positioned so that the receiving region 112 between the two panel sections is at the proper predetermined width. This receiving region 112 is defined by the interior surfaces 114 of the two panel sections 92, and the spacing distance (the distance between the surfaces 114) is indicated in FIG. 9 at 116.

When all of the tie-rod assemblies 50 are properly in place, as shown in the top part of FIG. 9, then the pour is made by pouring the concrete mix into the receiving region 112. After a period of time during which the concrete has cured, then the forming construction 82 can be dismantled. This would be accomplished by moving the retainers 74 on the right side of FIG. 9 from the related end of the tie-rod 52.

To loosen the tie-rod assembly from the concrete, the right end of the tie-rod 52 would be tapped with a hammer. After that, the entire tie-rod assembly 50 would be removed from the form structure 82. With the tie-rod assemblies 50 being removed, then the two wall form sections 84 and 86 would be removed from the concrete wall that has been formed. Since this can be done in a manner already accomplished in the prior art, this will not be described in this text.

There are a number of advantages to using the tie-rod assembly 50 of the present invention, and probably the term that would best describe these is the word "versatility". The metal stock from which the rods 52 can be cut are already available in the prior art, and these can be cut to different lengths to accommodate different applications. For example, if the wall to be formed is relatively thin (e.g. four inches), the tie-rods 52 could be made much shorter. This would be particularly advantageous if there are very small clearances in the construction area. In like manner, the sleeves 56 (which can be made rather inexpensively) could also be made smaller. Even if the wall thickness is small and the length of the sleeves 56 is substantially more than four inches, the relatively longer sleeves could still be used, since these would extend outwardly into the openings in the strongbacks 90 and the walers 88.

Further, there may be a situation where there is very little clearance on one side of the wall being formed, and more clearance on the other side. In that instance, the position of the sleeve 56 on each tie-rod 52 could be adjusted so that the sleeve would be positioned in the concrete receiving area 112, with one end of the rod 52 extending a greater distance out into the open area, and only a very short end portion of the rod being in the area where there is limited access.

Figures 10, 11, 12, 13, 14, 15, 16:
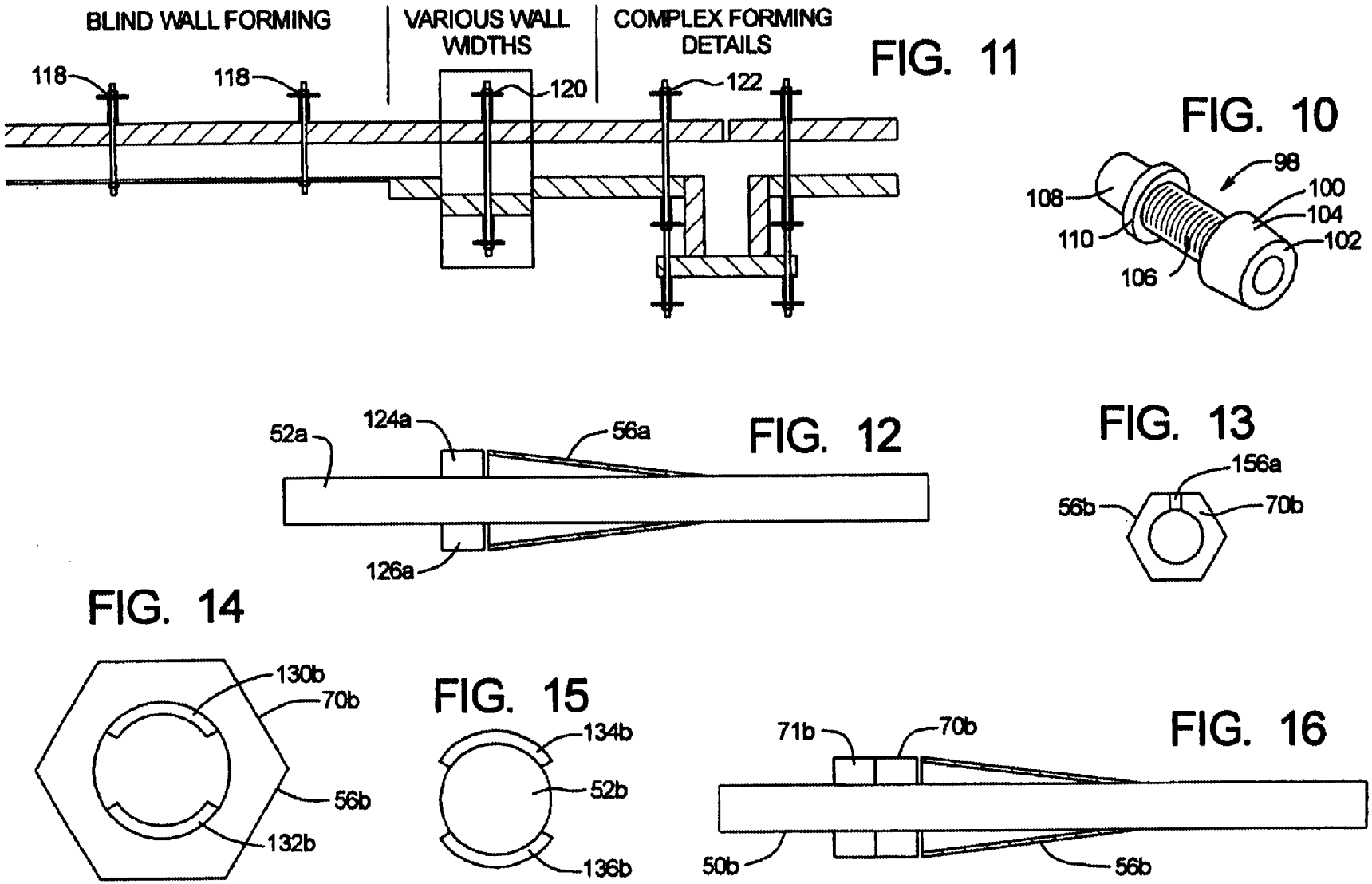
FIG. 10 is an isometric view showing a prior art positioning insert which could optionally be used in connection with the apparatus and method of the present invention.
FIG. 11 is a somewhat schematic view looking at various arrangements of concrete forming structures and showing three different situations where the present invention could be used in modified configurations, namely a connection being made to a form that is against an existing structure, second, a forming structure having to form a wall of great width, and third, a structure where a branch concrete wall section is being formed, and with the tie-rod assembly being of substantially greater length.
FIG. 12 is a side elevational view of a second embodiment of the tie-rod assembly of the present invention.
FIG. 13 is a sectional view taken along line 13—13 of FIG. 12, and showing the positioning nut with its associated set screw.
FIG. 14 is an end view of a portion of a third embodiment of the present invention, which is the end positioning nut which has a modified thread configuration and which is attached to its associated sleeve.
FIG. 15 is an end view of a tie-rod 52*b* of this third embodiment, which is arranged to be used in conjunction with the sleeve 56*b* of FIG. 14, this tie-rod 52*b* having a thread configuration matching those of the nut in FIG. 14.
FIG. 16 is a side elevational view of the sleeve of the third embodiment.

This versatility is illustrated in FIG. 11, where there are shown in side-by-side relationship, different situations which might be encountered in the configuration of the concrete forming structure. At the location shown at 118, it can be seen that there are tie-rod assemblies positioned where there is one blind wall which is very close to an existing structure. In this instance, the sleeve could be positioned much close to the end of the rod that is retained in the blind wall.

Then in the middle part of FIG. 11, there is shown a situation where the thickness of the wall is greater. In this instance, a sleeve 56 of greater length could be used, and the tie-rod could be made to an adequate length. Then in the right-hand side of FIG. 11, there is shown at 122 a situation where there is a branch wall being formed, and the forming structure has the branch extending outwardly therefrom. In this situation, the tie-rods 52 could be made of a much larger length, then the sleeves 56 could be positioned at the concrete receiving region 112.

c) Second Embodiment of the Present Invention

Also, it is to be understood that while the form of the sleeve illustrated in FIGS. 7 and 8 is presently considered to be the preferred embodiment, there are other possible arrangements for making the tie-rod assembly 52 with the sleeve 56 that could be moved to selected positions along its length.

A second embodiment is shown in FIGS. 12 and 13 where the rod 52*a* is without threads, and the sleeve 56*a* with an end collar 124*a* are unthreaded. Then there could be provided a set screw 126*a* which is moved into engagement with the rod 52*a*. Alternatively, the rod 52*a* could have the threads or corrugations on its surface, and this would provide a better seat for the set screw 156*a* in the rod 52*a*.

As another alternative, the threaded positioning member can be formed by crimping or forming the large diameter end of the sleeve, possibly in conjunction with other material to form the interim threads and also to form flat circumferential surfaces on the outer surface. Getting therefore, the positioning member can be formed as part of the sleeve by a crimping or forming operation (with or without additional metal material) in the positioning member can be connected to the sleeve by a metal to metal bonding material.

d) Third Embodiment of the Present Invention

Another possible arrangement is shown in FIGS. 14, 15, and 16. In the third embodiment there is the positioning nut 70*b* of the sleeve 56*b* and the interior circular area of the nut 70 is formed only with partial threads, with one set of threads 130*b* being formed over one arcuate interior segment slightly less than 90 degrees, and a similar second set of threads 132 (also having an arcuate length of moderately less than 90 degrees) being diametrically opposite from the threads 130*b*. Then in like manner, the rod 52*b* would have two sets of exterior threads 134*b* and 136*b*. Thus, the sleeve 56*b* with its nut 70*b* could be handled so that the threads 130*b* and 132*b* are offset from the exterior threads 134 and 136*b*. Then the sleeve 56*b* could be moved manually along the length of the rod 52*b* until the desired location is reached. The sleeve 56*b* would then be rotated 90 degrees so that the threads 120*b* and 132*b* are in engagement with the matching threads 134*b* and 136*b*.

It is to be understood that these two are given by way of example, and it is apparent that there is a variety of other attaching mechanisms which are already available in the prior art, and these are to be included within the broader scope of the present invention.

What is claimed is:

1. A tie-rod assembly arranged to be positioned in a concrete forming structure so as to extend through a concrete forming region and through two wall forming sections that define the concrete forming region, said tie-rod assembly comprising:

a) an elongate cylindrically shaped tie-rod having exterior threads along at least a portion of an outer cylindrical surface of the tie-rod;

b) a sleeve section comprising:

i) a tapered sleeve member defining a through passageway to receive the tie-rod, said tapered sleeve member having a smaller diameter circumferential forward end sized to fit closely to the exterior surface of the tie-rod, and having a larger diameter rear end spaced radially outwardly from the tie-rod, ii) a positioning member connected to the larger diameter portion of the tapered sleeve member, and having a threaded opening to receive the tie-rod and to threadedly engage the exterior threads of the tie-rod, iii) a locking member in positive engagement with the tapered sleeve member and fixedly positioning said tapered sleeve member to the elongate cylindrically shaped tie-rod, c) said tie-rod and said sleeve section being arranged so that with the sleeve section positioned with the tie-rod extending therethrough, the sleeve section can be rotated, and with the threaded positioning member engaging the threads of the tie-rod, move the sleeve-section to a desired location along the tie-rod; and d) said tapered sleeve member being configured to extend through the concrete forming region and having a connection to the tie-rod that is also adapted to be positioned through the concrete forming region through the through passageway of the tapered sleeve member where after the concrete wall is formed, the tie-rod assembly is adapted to be removed by impacting the front end of the tie-rod and causing the tie-rod assembly to be moved out of the concrete wall formed in the forming region.

2. The tie-rod assembly as recited in claim 1, wherein said tapered sleeve member has its through passageway configured so as to expand in a direction from the forward end to the rear end of the sleeve member.

3. The assembly as recited in claim 1, wherein said tapered sleeve member is formed in the form of a closed metal sheet having the configuration of a truncated cone.

4. The assembly as recited in claim 1, wherein the locking member comprises a lock nut which threadedly engages the tie-rod and is able to be rotated into engagement with the positioning member to retain the positioning member at a position on the tie-rod.

5. The assembly as recited in claim 1, wherein the positioning member is connected to the sleeve by means of a metal to metal bonding material.

6. The assembly as recited in claim 1, wherein the positioning member is formed as part of the sleeve by a crimping or forming operation at the large diameter end portion of the sleeve.

7. The assembly as recited in claim 6, wherein said crimping or forming operation is accomplished by use of additional metal material at the larger diameter portion of the sleeve.

8. The assembly as recited in claim 1, wherein the exterior threads on the tie-rod are partial threads which provide at least one gap along a length or partial length of the tie-rod, and said positioning member has a partial thread or threads able to pass through said gap, and with the positioning member being rotated to cause engagement of the thread or threads of the positioning member with the threads of the tie-rod.

9. The assembly as recited in claim 8, wherein said tie-rod has two sets of partial threads positioned at spaced locations around the circumference of the tie-rod, and the thread or threads of the positioning member comprising two sets of each of a partial thread or threads able to pass through the two gaps of the threads on the tie-rod.

10. A method of providing tie-rod connections for a forming structure for concrete walls having first and second forming sections on opposite sides of the forming region where the concrete wall is to be made, said method comprising:

a) providing a plurality of tie-rod assemblies, each of which comprises:

i) a elongate cylindrically shaped tie-rod having exterior threads along at least a portion of an outer cylindrical surface of the tie-rod;

b) providing a plurality of sleeve sections, each of which comprises:

i) a tapered sleeve member having a forward end and a rear end and defining a through passageway to receive the tie-rod said tapered sleeve member having an outer tapered surface with a small diameter forward circumferential edge sized to fit closely to the exterior surface of the tie-rod, and having a larger diameter rear end spaced radially outwardly from the tie-rod;

ii) a positioning member connected to the larger diameter portion of the tapered sleeve member, and having a threaded opening to receive the tie-rod and to threadedly engage the exterior threads of the tie-rod;

iii) a locking member in positive engagement with the tapered sleeve member and fixedly positioning said tapered sleeve member to the elongate cylindrically shaped tie-rod, c) mounting each of the sleeve sections onto each of the tie-rods, and adjusting the positions of the sleeve sections on the tie-rods so that end portions of the tie-rod extending beyond the forward and rear ends of the sleeve section are sufficiently long so that the end portions of the tie-rods are able to extend through the forming sections to connecting locations and the sleeve sections extend through the forming region;

d) applying retaining devices at the connecting locations at the opposite ends of the tie-rods to position the forming structures at the proper location for forming the concrete wall;

e) pouring the concrete wall and permitting the concrete wall to cure, and applying a force to the first end of the tie-rod assembly to drive the tie-rod loose from the concrete wall structure and removing the tie-rod assembly from the wall structure.

11. The method as recited in claim 10, wherein said tapered sleeve member has its through passageway configured so as to expand in a direction from the forward end to the rear end of the sleeve member.

12. The method as recited in claim 10, wherein said tapered sleeve member is formed in the form of a closed metal sheet having the configuration of a truncated cone.

13. The method as recited in claim 10, wherein the locking member is a lock nut which threadedly engages the tie-rod rotating the lock nut into engagement with the positioning member to retain the positioning member at a position on the tie-rod.

14. A tie-rod assembly arranged to be positioned in a concrete forming structure so as to extend through a concrete forming region and through two wall forming sections that define the concrete forming region, said tie-rod assembly comprising:

a) an elongate tie-rod;

b) a sleeve section comprising:

i) a tapered sleeve member having a forward end and a rear end and defining a through passageway to receive the tie-rod, said tapered sleeve member having an outer tapered surface with a smaller diameter forward circumferential edge sized to fit closely to the exterior surface of the tie-rod, and having a larger diameter rear end spaced radially outwardly from the tie-rod:

ii) a positioning member connected to the larger diameter end of the tapered sleeve member, and having an opening to receive the tie-rod and having a fastening device to engage the exterior surface of the tie-rod;

iii) a locking member in positive engagement with the tapered sleeve member and fixedly positioning said tapered sleeve member to the elongate cylindrically shaped tie-rod, c) said tie-rod and said sleeve section being arranged so that with the sleeve section positioned with the tie-rod extending therethrough, the sleeve section can be moved to a desired location along the tie-rod and the fastening device locked to the tie-rod; and d) said tapered sleeve member being configured to extend through the concrete forming region and having a connection to the tie-rod that is also adapted to extend through the concrete forming region through the through passageway of the tapered sleeve member where after the concrete wall is formed, the tie-rod assembly can be removed by impacting the front end of the tie-rod and causing the tie-rod assembly to be moved out of the concrete wall formed in the forming region.

15. The tie-rod assembly as recited in claim 14, wherein said tapered sleeve member has its through passageway configured so as to expand in a direction from the forward end to the rear end of the sleeve member.

16. The assembly as recited in claim 14, wherein said tapered sleeve member is formed in the form of a closed metal sheet having the configuration of a truncated cone.

17. The assembly as recited in claim 14, wherein the locking member is a lock nut which threadedly engages the tie-rod and is able to be rotated into engagement with the positioning member to retain the positioning member at a position on the tie-rod.

18. The assembly as recited in claim 14, wherein the positioning member is connected to the sleeve by means of a metal to metal bonding material.

19. The assembly as recited in claim 14, wherein the positioning member is formed as part of the sleeve by a crimping or forming operation at the large diameter end portion of the sleeve.

20. The assembly as recited in claim 14, wherein said positioning member has an opening extending through a side wall portion of said positioning member, and said fastening device is inserted through said side opening.

* * * * *